US005487423A

United States Patent [19]

Romero

[11] Patent Number: 5,487,423

[45] Date of Patent: Jan. 30, 1996

[54] HEAT EXCHANGER

[75] Inventor: Francis Romero, Angers Cedex, France

[73] Assignee: Piscine Service Anjou SA, France

[21] Appl. No.: 349,472

[22] Filed: Dec. 5, 1994

Related U.S. Application Data

[63] Continuation of Ser. No. 17,746, Feb. 16, 1993, abandoned.

[51] Int. Cl.[6] ..... F28D 7/10

[52] U.S. Cl. ..... 165/156; 165/162; 165/163

[58] Field of Search ..... 165/156, 162, 165/163, 905

[56] References Cited

U.S. PATENT DOCUMENTS

| | | | |
|---|---|---|---|
| 2,508,247 | 5/1950 | Giauque | 165/156 X |
| 2,668,692 | 2/1954 | Hammell | 165/156 |
| 3,850,230 | 11/1974 | Margen | 165/66 |
| 4,061,184 | 12/1977 | Radcliffe | 165/38 |
| 4,242,001 | 12/1980 | Meintker et al. | 366/75 |
| 4,257,479 | 3/1981 | Newton | 165/156 |
| 4,366,859 | 1/1983 | Keyes | 165/184 |
| 4,714,107 | 12/1987 | Adsett | 165/905 X |
| 4,895,203 | 1/1990 | McLaren | 165/41 |

*Primary Examiner*—Allen J. Flanigan

*Attorney, Agent, or Firm*—Laff, Whitesel, Conte & Saret, Ltd.

[57] ABSTRACT

It is used to reheat a secondary fluid such as pool water or sea water. It comprises a body provided with an inlet for the secondary fluid to be reheated and an outlet for the reheated fluid, a sleeve inside the body, a coil in which the primary fluid circulates and which is housed inside the annular space between the body and the sleeve and outside of which the water to be reheated passes. The body (1) and the sleeve (8) are made of a plastic-based material, either reinforced or not, and the coil (10) is made of titanium.

3 Claims, 1 Drawing Sheet

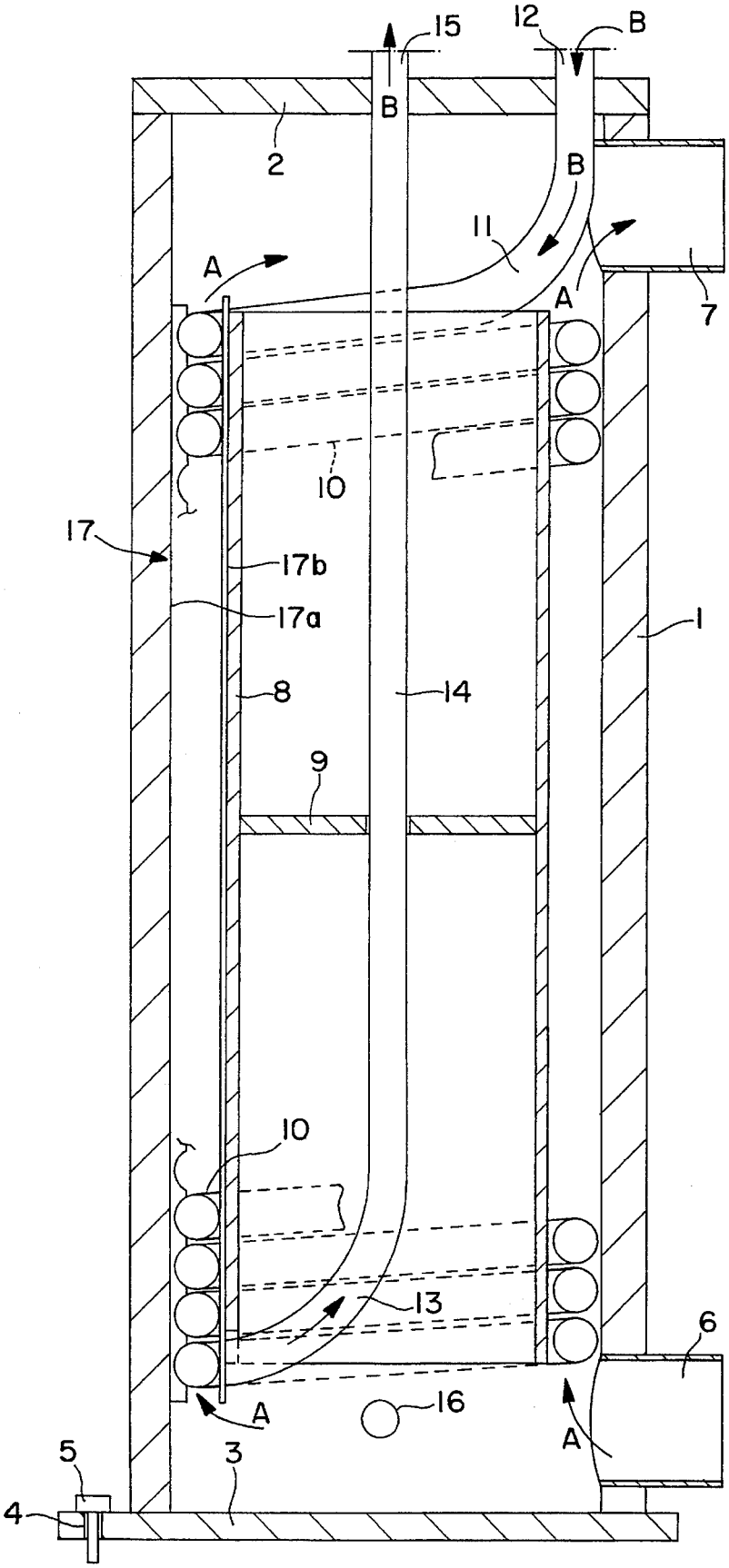
15
12
B
B
2
B
11
A
A
7
10
17
17b
17a
1
8
14
9
10
13
6
16
A
A
5
3
4

HEAT EXCHANGER

This application is a continuation of application Ser. No. 08/017,746, filed Feb. 16, 1993, abandoned.

The present invention concerns a tubular heat exchanger which through a primary and heated fluid passed to reheat a secondary fluid such as pool water or sea water.

Heat exchangers of this type are already known. In this connection, reference is made to e.g. FR-A-2 441 819, FR-A-2 482 717, DE-A-3 038 344 and U.S. Pat. No. 4,739,634. The exchangers described in these documents are formed by a cylindrical body provided with an inlet and an outlet for the secondary fluid. Inside the body, a helical coil is provided through which passes in order to transfer its calories to the secondary fluid circulating in the body.

Generally, in order to increase the efficiency of the heat transfer, the secondary fluid is circulated to mach as much contact as possible with the coil. To accomplish this, the latter is housed in the annular space formed between the inside wall of the body and the outside wall of an annular sleeve. Thus, the secondary fluid circulates helically between coil turns within the annular space.

This, then, creates corrosion problems which, in the majority of the applications, are solved, as in the patents DE-A-3 038 344 and U.S. Pat. No. 4,739,634, by using separators between the outside body and the sleeve.

Nevertheless, taking into account the particular use for which the exchangers of the invention are intended, namely reheating pool water and sea water, this measure is not adequate. In fact, pool water contains an oxidizing agent, for example chlorine, and is therefore corrosive.

It is, therefore, the object of the invention to provide a heat exchanger designed especially for reheating a corrosive secondary fluid, such as pool water or sea water.

It was found that satisfactory results were obtained by making the outside body from a plastic-based material and the coil tube of titanium and by furnishing the coil with supporting and stabilizing spacers or separators between the outside wall of the sleeve and the inside wall of the body.

A heat exchanger according to the invention is shown in FIG. 1 in a longitudinal cross section.

It comprises an external cylindrical body 1 having a generally cylindrical shape and closed airtight covers affixed on the upper end (cover 2) and , on the lower end (base 3). The base 3 is provided with means, such as holes 4 for the passage of screws 5, which allow the exchanger to be fixed to a support such as the ground.

At the lower end, in the cylindrical wall of the body 1, a pipe connection 6 is provided which forms the inlet for the secondary fluid by which the water to be reheated is introduced, for example, the water coming from a pool. At the upper end, on the same generator as pipe connection 6, a pipe connection 7 is provided which forms the outlet by which the reheated water in the exchanger returns to the pool.

The inside diameters of the pipe connections 6 and 7 are dimensioned such that the exchanger can be connected to a circuit in which the secondary fluid can circulate, without loss of excessive heat, with a relatively significant output, that is between 5 and 20 $m^3$/hour, by means of a pump. These diameters are, for example, in the order of 40 mm.

The fact that the exchanger can be operated at relatively high rates prevents the formation of deposits coming from the pool water and from its filtration system.

Co-axially located inside the body 1, a sleeve 8 is formed by a cylindrical tube furnished with an internal radial partition 9.

In the annular space between the inside wall of the body 1 and the outside wall of the sleeve 8, a coil 10 formed by a helical tube is mounted. At its upper end, the coil 10 ends in an elbow 11 extending, tightly sealed, through the cover 2 coil 10 and has an inlet 12 by which the heated primary fluid is introduced. At the other end, the coil 10 forms an elbow 13 extended by a rectangular part 14 which also passes, tightly sealed, through the cover 2, running into an outlet 15 which is in the vicinity of input 12 and by which the heated primary fluid leaves after having transferred its calories to the pool or secondary water. The rectangular part 14 also passes through the inside partition 9 of the sleeve 8.

Sleeve 8 is affixed to the coil 10 by appropriate means (not shown).

At the lower end of the body 1, a temperature pick-up 16 is mounted whose output signal can be used to control the circulation of the primary and secondary fluids in the exchanger.

According to the invention, the body 1 and the sleeve 8 are made from a plastic-based material, either reinforced or not, such as PVC or, advantageously, polyester reinforced with glass fibers. The coil 10 is made of titanium.

On the one hand, separators **17*a* are provided between the inside wall of the body 1 and the coil 10. The separators are in the form of a vertical strip which has a width that is smaller than the diameter of the body 1. Outside separators 17*a* have a series of covers therein, each cover receiving and stabilizing the position of an individually associate turn of the coil for housing each of the turns of the coil 10. On the other hand, separators 17*b* are strips provided between the outside wall of the sleeve 8 and the coil 10. These separators 17*b* are in the form of a strip with a width which is also smaller in width in relation to the diameter of the sleeve 8. The separators 17*b* take up any available space in order to push the coil turns into the individual coves. The separators 17*a* and 17*b* preferably keep the coil 10 at a distance of about 2 mm, both from the body 1 and from the sleeve 8**.

The function of the separators **17*a* and 17*b* is multiple. It facilitates the mounting of the coil 10 which appears, once the separators 17a are in position. It also avoids relative movements between, on the one hand, body 1 and sleeve 8 and, on the other hand, coil 10**, such movements being produced by vibrations of pumps and accessories about the exchanger and which can lead to a friction which deteriorates the elements of the exchanger.

It is also used to solve the problems associated with corrosion in two ways. On the one hand, separators 17a and 17b create areas situated between sleeve 8 and coil 10 and between body 1 and coil 10 which are, from the point of view of corrosion, dead. On the other hand, by dividing the flowing spaces for the secondary fluid about coil 10, they facilitate its flow and allow its circulation at higher rates.

In conclusion, it will be noted that the fact that the separators **17*a* have cover or housings for receiving each turn of the coil 10 which allows a release of the coil diameter gaps of each turn, these gaps being compensated by the differences in thickness which hold, when the exchanger is assembled, the separators 17*a*** between their outer side and their housing.

The water to be reheated flows helically upwardly in the body 1 (arrows A), on the one hand, between any two consecutive turns of the coil 10 and, on the other hand, between coil 10 and body 1 or sleeve 8. In contrast thereto, the primary fluid flows downward (arrows B) in coil 10, that is, countercurrently to the water of the secondary fluid.

The primary fluid is, for example, a refrigerating agent coining from a heat pump (not shown), but it could also be water vapor or hot water.

I claim:

1. A heat exchanger for reheating a secondary fluid such as a pool of fresh or sea water, said exchanger comprising a hollow cylindrical body (1) having an inlet for receiving said secondary fluid to be reheated and an outlet for discharging said reheated fluid, a sleeve (8) co-axially located inside the body and spaced from an inside wall of said body and forming an annular space there between, a coiled tube (10) in which the primary fluid circulates and which is located inside and co-axially with said annular space, an intake (12) and an output (15) for said coiled tube 10, one end of said coiled tube being coupled directly to one of said intake and said output, an opposite end of said coiled tube being coupled to the other of said intake and said output via a pipe extending through a center of said coiled tube, the secondary fluid passing through said annular space and over said coiled tube, the body (1) and the sleeve (8) being made of a reinforced polyester plastic-based material, the coiled tube (10) being made of titanium, a first spacer (17*a*) between the inside wall of the body (1) and the coiled tube (10), said first spacer being a strip provided with a series of recesses for individually receiving and supporting each turn of the coiled tube (10), and a second spacer (17*b*) between the outside wall of the sleeve (8) and the coiled tube (10), said second spacer being a strip pushing said individual turns against said supporting shapes in said first spacer.

2. A heat exchanger for reheating a secondary fluid such as a pool of fresh or sea water, said exchanger comprising a hollow cylindrical body (1) having an inlet for receiving said secondary fluid to be reheated and an outlet for discharging said reheated fluid, a sleeve (8) co-axially located inside the body and spaced from said body and forming an annular space therebetween, the body (1) and the sleeve (8) being made of a reinforced polyester plastic-based material, a coiled tube (10) in which the primary fluid circulates and which is located inside said annular space, the secondary fluid passing through said annular space and over said coiled tube, the coiled tube (10) being made of titanium, a first spacer (17*a*) between an inside wall of the body (1) and the coiled tube (10), said first spacer being an undulating strip provided with a series of arcuate recesses for individually receiving and supporting each turn of the coiled tube (10), and a second spacer (17*b*) between the outside wall of the sleeve (8) and the coiled tube (10), said second spacer being a strip which is smooth on opposite sides for pushing said individual turns against said supporting shapes in said first spacer whereby said coil is installed and locked in space by the sliding of said second spacer into an area between said outside wall of the sleeve and said coiled tube for locking said individual turns in said arcuate recesses.

3. A heat exchanger for reheating a secondary fluid such as a pool of fresh or sea water, said exchanger comprising a hollow cylindrical body (1) having an inlet for receiving said secondary fluid to be reheated and an outlet (15) in one end of said body for discharging said reheated fluid, a sleeve (8) co-axially located inside the body and spaced from said body and forming an annular space therebetween, the body (1) and the sleeve (8) being made of a reinforced polyester plastic-based material, a coiled tube (10) in which the primary fluid circulates and which is located inside and co-axially with said annular space, the coiled tube (10) being made of titanium, one end of said coiled tube being coupled directly to one of an intake (12) and an output (15), an opposite end of said coiled tube being coupled to the other of said intake and said output via a pipe extending through a center of said coiled tube, the secondary fluid passing through said annular space, and over said coiled tube, a first spacer (17*a*) between an inside wall of the body (1) and the coiled tube (10), said first spacer being an undulating strip having a series of arcuate recesses for individually receiving and supporting each turn of the coiled tube (10), and a second spacer (17*b*) between an outside wall of the sleeve (8) and the coiled tube (10), said second spacer being a strip which is smooth on opposite sides for pushing said individual turns of the coiled tube against said arcuate supporting shapes in said first spacer and for locking said individual turns in said arcuate recesses.

* * * * *